US009266706B2

(12) United States Patent
Forestelli et al.

(10) Patent No.: US 9,266,706 B2
(45) Date of Patent: Feb. 23, 2016

(54) METHOD AND PLANT FOR FILLING BOTTLES OR CONTAINERS WITH CONTINUOUS CALIBRATION

(75) Inventors: Fabio Forestelli, Alseno (IT); Alberto Cirio, Canelli (IT)

(73) Assignees: FT SYSTEM S.R.L., Alseno (PC) (IT); AROL S.P.A., Canelli (AT) (IT)

( * ) Notice: Subject to any disclaimer, the term of this patent is extended or adjusted under 35 U.S.C. 154(b) by 969 days.

(21) Appl. No.: 13/395,846

(22) PCT Filed: Sep. 8, 2010

(86) PCT No.: PCT/IB2010/002266

§ 371 (c)(1),
(2), (4) Date: May 23, 2012

(87) PCT Pub. No.: WO2011/030211

PCT Pub. Date: Mar. 17, 2011

(65) Prior Publication Data

US 2012/0222387 A1 Sep. 6, 2012

(30) Foreign Application Priority Data

Sep. 14, 2009 (IT) ..... MI2009A001570

(51) Int. Cl.
*B65B 5/00* (2006.01)
*B65B 7/16* (2006.01)
(Continued)

(52) U.S. Cl.
CPC . *B67C 3/007* (2013.01); *B67B 3/26* (2013.01); *B67B 3/261* (2013.01)

(58) Field of Classification Search
CPC ..... B65B 7/2835; B65B 1/04
USPC ..... 53/266.1, 467, 471, 473, 468, 484, 490, 53/502, 317, 52; 141/94, 196; 356/429, 356/431; 382/141, 142
See application file for complete search history.

(56) References Cited

U.S. PATENT DOCUMENTS 4,608,806 A * 9/1986 Haslam et al. ..... 53/314
4,674,340 A * 6/1987 Burt et al. ..... 73/862.23
(Continued)

FOREIGN PATENT DOCUMENTS

DE 28159080 A1 10/1979
DE 102006062536 A1 7/2008

OTHER PUBLICATIONS

EPO machine translation of DE 2815980, retrieved Mar. 23, 2015, 9 pages.*

(Continued)

*Primary Examiner* — Stephen F Gerrity
*Assistant Examiner* — Eyamindae Jallow
(74) *Attorney, Agent, or Firm* — Hedman & Costigan, P.C.; James V. Costigan; Kathleen A. Costigan

(57) ABSTRACT

The present invention refers no a plant for filling bottles or containers with continuous calibration and to a continuous calibration method of such a plant. The calibration method (100) is characterized in that it comprises the steps consisting of collecting (110) at least one set of data relating to filling and/or closing parameters of containers or bottles (16) treated through the same tap or filling valve (15) of the filling plant (10) and/or through the same closing and/or capping head (14) of the filling plant (10); based on the data collected, calculating (120) statistical data associated with the tap or filling valve (15) and/or with the closing and/or capping head (14); updating (130) the statistical data based on new data collected and monitoring the progression thereof; in the case of a variation of the statistical data over time, adjusting the tap or filling valve (15) and/or the closing and/or capping head (14) associated with the statistical data so as to compensate for the variation.

6 Claims, 2 Drawing Sheets

(51) Int. Cl.
*B67C 3/00* (2006.01)
*B67B 3/26* (2006.01)

(56) References Cited

U.S. PATENT DOCUMENTS 4,691,496 A * 9/1987 Anderson ..... B65B 57/10 141/144
4,794,801 A * 1/1989 Andrews et al. ..... 73/862.23
4,796,787 A * 1/1989 Tsuyuki ..... 222/64
4,811,850 A * 3/1989 Bankuty ..... B07C 5/34 209/529
6,804,929 B2 * 10/2004 Kemnitz ..... 53/75
7,059,104 B2 * 6/2006 Taylor ..... 53/471
2001/0018820 A1 * 9/2001 Kitamoto ..... 53/490
2002/0073652 A1 * 6/2002 Wiedemann ..... 53/425
2002/0148205 A1 * 10/2002 Takebe et al. ..... 53/490
2006/0162285 A1 7/2006 Haynes
2006/0242929 A1 * 11/2006 Servadei et al. ..... 53/490
2007/0107801 A1 5/2007 Cochran et al.
2009/0293437 A1 * 12/2009 Schulz et al. ..... 53/490

OTHER PUBLICATIONS

International Search Report Dated Jan. 21, 2011.

* cited by examiner

METHOD AND PLANT FOR FILLING BOTTLES OR CONTAINERS WITH CONTINUOUS CALIBRATION

The present invention refers no a plant for filling bottles or containers with continuous calibration and to a continuous calibration method of such a plant. Conventional lines for filling bottles or containers made from plastic, like for example PET, HDPE, PE and so on, aluminium containers, like for example cans, or else polythene-coated cardboard containers (cartons), containing any type of liquid, are generally made up of a station for filling the bottles or containers, followed by a closing and/or capping station of the bottles or containers, as well as by one or more control stations arranged downstream of the closing station.

The filling and closing stations in turn comprise a plurality, respectively, of taps or filling valves and of closing and/or capping heads of the mechanical or electronic type depending on the particular embodiment of the plant.

The filling and closing/capping stations are initially calibrated or set electronically so as to obtain the desired result in output in terms of filling and closing, depending on the particular container that it is wished to treat.

The actual obtaining of the set filling and closing parameters is then monitored by the possible control stations arranged downstream, through which it is possible to inspect the filled bottles or containers, determining whether they do or do not have the filling and closing characteristics that are wished to be obtained.

In particular, according to the specific implementation of the filling line, the control stations make it possible to verify the fill level, the position of a possible cap with respect to the bottle or the container, the tension of the container in response to a pressure exerted and so on.

The causes that can lead to a divergence between the set filling and closing values and the actual ones are many and of various types. For example, there is a substantial divergence in the case of jamming in the system for moving forward the containers or a blockage in the filling or capping tools.

In this case, the control stations downstream indicate the container or the bottle not correctly treated and the plant takes care of discarding it.

Moreover, also the wear or the mechanical creep of the filling valves and/or of the capping heads can slowly lead to ever greater deviations from the reference values.

Even if, through the control stations, it is possible to detect substantially any gross divergence between the desired filling and closing values and the actual ones, the small differences that still fall within the tolerance ranges are not indicated by the control stations as irregularities.

Therefore, the effects that are due to wear or mechanical creep can only be noticed by the control stations of the filling or closing of a bottle when they have reached a level such that the measured values fall outside of the tolerance ranges.

In this case, however, it is difficult to work out the particular causes for the irregularities since the gradual divergence from the desired values has not been detected, but just the fact that the tolerance threshold has been passed.

Moreover, in the absence of a tracking system of the particular filling valves and capping heads that have treated a certain container, from a detection of values outside of the tolerance ranges, it is not obvious to work out which particular tool is in such a worn or creep condition.

Last but not least, the control stations currently used are unable to provide the data necessary to correct possible deviations due to wear or creep, in particular in filling valves and capping heads of the electronic type that require the particular measurement of some parameters currently only able to be determined through laboratory tests.

The purpose of the present invention is to avoid the aforementioned drawbacks and in particular to make a plant for filling bottles or containers that is able to detect and quantify a condition of creep and/or wear of a particular filling valve and/or capping head while it is being used.

Another purpose of the present invention is to provide a plant for filling bottles or containers that is able to automatically and continuously carry out a calibration suitable for compensating for a detected creep and/or wear condition.

A further purpose of the present invention is to make a plant for filling bottles or containers that is able to automatically carry out a calibration to compensate for wear creep also upon electronic filling valves and/or capping heads.

The last but not least purpose of the present invention is to devise a method for calibrating a plant or filling bottles or containers capable of identifying and compensating or possible conditions of creep and/or wear of a particular filling valve and/or capping head before the effects of such a condition lead to discarding a bottle treated by them.

These and other purposes according to the present invention are accomplished by making a plant for filling bottles or containers and a method for calibrating the same as outlined in the independent claims.

Further characteristics of the plant and of the method are the object of the dependent claims.

The characteristics and advantages of a plant for filling bottles containers and of a method for calibrating such a plant, according to the present invention, will become clearer from the following description, given as a non-limiting example, referring to the attached schematic drawings, in which.

Figure 1:
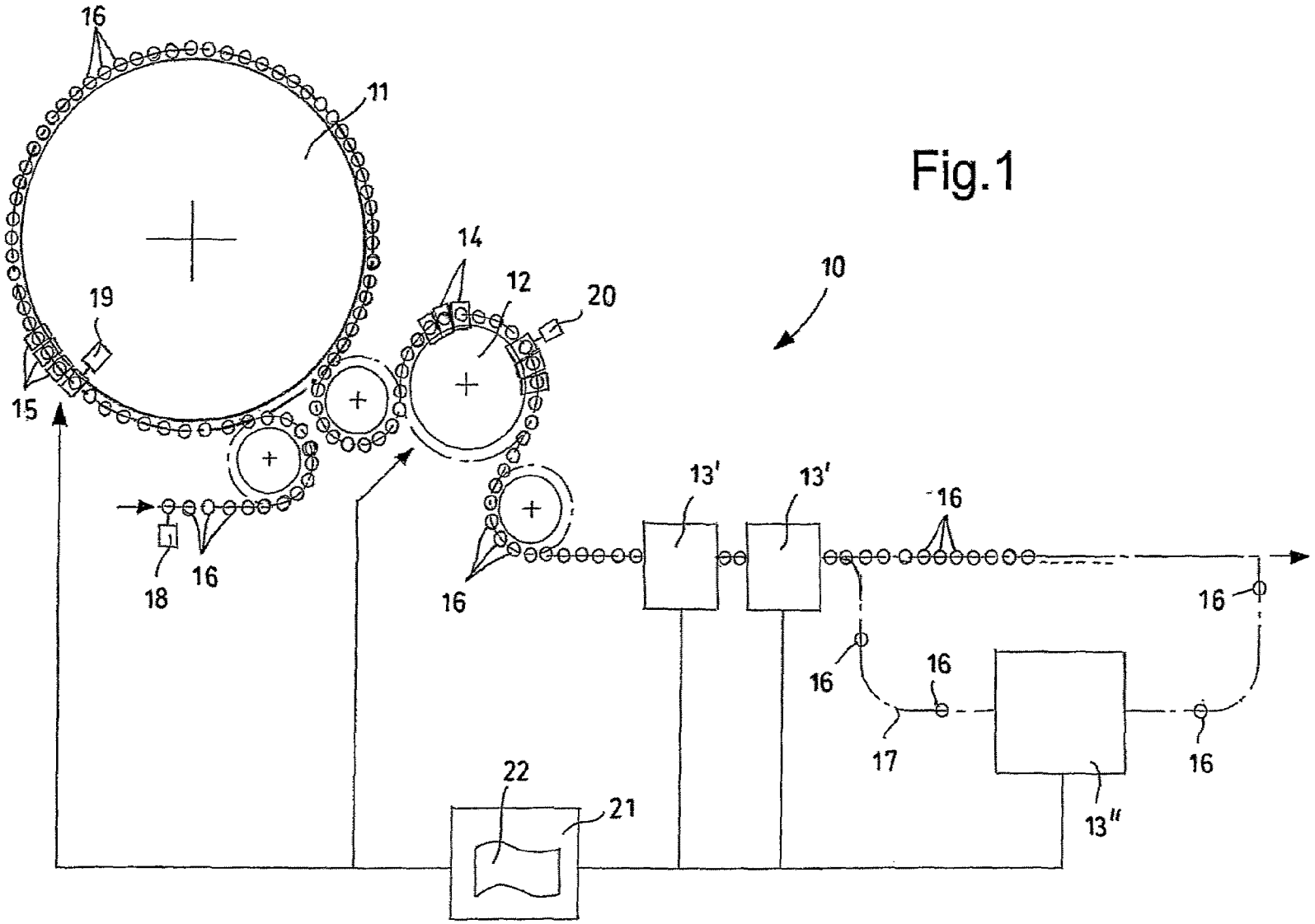
FIG. 1 is a schematic plan view of a preferred embodiment of the plant for filling bottles or containers according to the present invention.
Figure 2:
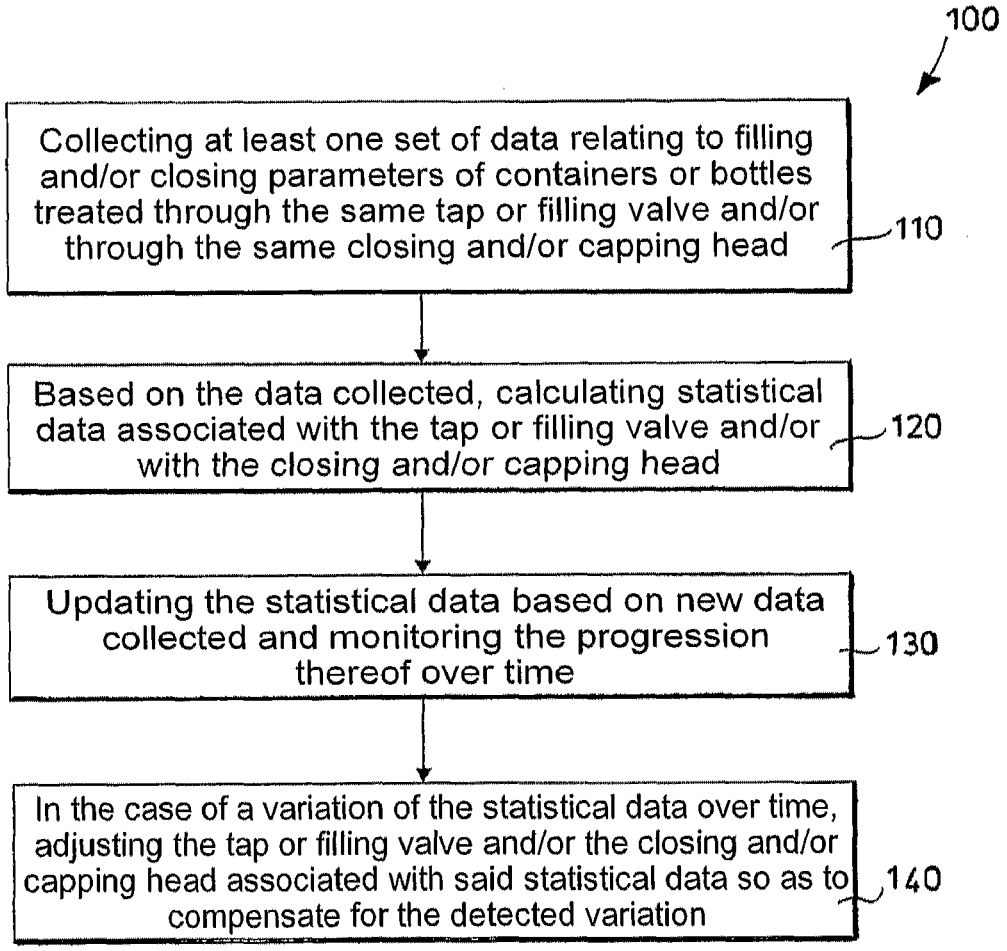
FIG. 2 is a block diagram of the method for calibrating a plant for filling bottles or containers according to the present invention.

With reference to the figures, a plant for filling bottles or containers is shown, wholly indicated with 10.

Such a plant comprises a first filling station 11 of bottles or containers 16, followed by a second station 12 for closing and/or capping the bottles or containers 16.

The filling and closing stations in turn comprise a plurality, respectively, of taps or filling valves 15 and of closing and/or capping heads 14 constrained to move forward along the periphery of the respective first and second station 11,12 so as to follow the bottles being treated for a section, filling and/or capping them in movement.

Preferably, the first 11 and the second 12 station have a circular configuration, in which the taps or filling valves 15 and the closing and/or capping heads 14 are connected to the periphery of a turntable or carousel. Such stations 11,12 can for example be tool-holders provided respectively with about 80 individual taps or filling valves 15 and with about 20 closing and/or capping heads 14.

The containers or bottles 16 are transported through special means, like for example a set of conveying means connected and free on a conveyor belt, along a path that at least partially follows the periphery of the first 11 and second 12 station.

The path that the containers or bottles 16 travel along is divided into a plurality of discrete positions that the containers 16 take up as the move forward along the filling line.

At the entry no the forward displacement means there is a first sensor 18 that detects the passage of a first bottle or container 16.

Similarly, a first filling tap 15 and a first capping head 14 are associated with respective sensors 19,20 that keep track of the position of them 14,15 inside the respective stations 12,11.

Finally, there is a special encoder (not illustrated) associated with the forward displacement means that, knowing the relative distances in terms of machine steps, keeps track of the machine positions in which the containers 16, the taps 15 and the capping heads 14 are located.

In this way, it is possible to work out the particular tools (tap 15 and capping head 14) that act upon each container 16.

Downstream of the second station 12 with respect to the direction of forward movement of the container 16 there is also at least one control station 13',13".

The control stations 13',13" can be arranged in line along the main forwarding route of the bottles 16, or else along a parallel secondary branch 17 of the plant 10, according to whether a control is carried out on all of the filled containers 16 or else a sampling control is carried out only on a subset of treated containers 16 conveyed along the secondary branch by special deviator means.

Such control stations 13',13" can for example comprise one or more of die following measuring modules:

- module for measuring the fill level,
- module for measuring the tension of the side walls,
- module for measuring the capping height,
- module for measuring the removal torque and/or the reclosing angle,
- module for measuring the gas content and/or the pressure,
- module for measuring the weight, or
- module for measuring the colour.

In particular, the plant for filling bottles and containers 16 according to the present invention comprises at least one control station 13',13" provided with a module for measuring the fill level and one among the module for measuring the capping height and the module for measuring the screwing angle and/or the removal torque of the cap.

The control stations 13' positioned in line, directly downstream of the filling 11 and closing 12 stations preferably comprise the modules for measuring the fill level, the tension of the side walls and/or the capping height.

The control stations 13" for sampling control, arranged along the secondary branch 17, preferably comprise the modules for measuring the removal torque and/or the reclosing angle of the cap, the weight, the gas content and/or the pressure, as well as the colour. The module for the fill level, control can be implemented with various technologies, according to the container 16 and the liquid to be controlled, the speed of the filling line 10 and the precision required. Normally a high-frequency module or high-frequency capacitive module, generally used for all food is used: the bottles pass through a measurement bridge made up of two metal plates that oscillate at high frequency. The plates are suitably connected to an electronic board dedicated to the measurement of the variation in frequency or capacity as the bottles pass. The variations are proportional to the amount of liquid. The detected values, suitably filtered and amplified, are processed by a processing unit (not illustrated) in order to evaluate whether to accept or discard the container 16 under analysis.

Alternatively, to make the module for measuring the fill level it is possible to use an X-ray source generally used for all types of containers and liquids. Such an X-ray source is made up of a generator intended to emit a beam of rays capable of penetrating the passing bottles and striking a reception sensor known scintillator. According to the amount of rays striking the receiver, a processing unit (not illustrated) is able to evaluate whether to accept or discard the container 16 under analysis.

In order to check the fill level it is also possible to use industrial video cameras. The video camera correlated to a suitable lighting system, takes a photograph of all the samples under analysis and suitable software means for processing images calculate the fill level determining whether to accept or discard the container 16.

The module for controlling the tension of the side walls can for example be implemented through a pressure transducer using different technologies such as linear or proximity transducers, load cells, lasers, and so on. Whether to accept or discard the container 16 is determined based on suitable processing of the values detected by the transducer.

The module for measuring the capping height preferably comprises industrial video cameras correlated to a suitable lighting system that take one or more photographs of the containers under analysis. From electronic processing of the images the capping height can be determined and it can be decided whether to discard or accept the container 16.

The module for measuring the weight preferably comprises a metrically approved balance in order to provide an exact measurement of the weight of the filled container 16, also able to be used for certification purposes.

In the case of closing of the container 16 by screwing, the module for measuring the removal torque and/or the reclosing angle of the cap preferably comprises a torsion meter or dynamometric key for measuring the removal, torque necessary to unscrew the cap. For this purpose the torsion meter is associated with an electric motor, preferably brushless, which applies a torque during a predetermined angular excursion, in general until the yielding point, and therefore the opening point, of the cap is reached.

The module also preferably comprises a sensor of the angular excursion carried out by the motor to close up the cap applying a predetermined torque.

Advantageously, there is also a module for measuring the gas content and/or pressure arranged so as to carry out the measurement immediately after the measurement carried out by the module for measuring the removal torque and/or the reclosing angle to verify that during the screwing control step the container has been correctly closed back up.

Such a module for measuring the gas content and/or pressure can for example be made in an analogous way to the module for measuring the tension of the side walls, therefore through a pressure transducer.

Finally, there is preferably a module for measuring the colour made through suitable colorimeters.

The single control stations 13',13" having one or more measuring modules, are connected to an electronic processing unit 21 for processing control data detected and associated with a particular capping head 14 and/or filling tap 15.

In turn, the electronic processing unit 21 is provided with software means 22 suitable for creating a database of the measurement values received, associated with a particular capping head 14 and/or tap 15, determining a plurality of statistical parameters from it, such as the average value, the standard deviation or else the statistical indices Cp and cpk that indicate the ability of the system to produce a result within the predefined limits, in order to describe the statistical behaviour of such a capping head 14 and/or tap 15, analysing the progression of the statistical parameters in a temporal range in order to detect a variation over time of such values that is due to wear or creep and quantify its extent.

The electronic processing unit 21 is also preferably connected to adjustment means (not illustrated) of the first and second station 11,12 that control the operating parameters respectively of the single taps 15 and of the single capping heads 14 (like for example the opening times of the taps 15 and the removal torque as well, as the reclosing angle of the capping heads 14) in order to carry out a calibration thereof based on the detected variations.

It is thus possible to carry out a continuous and automatic calibration of the single capping heads 14 and of the single taps 15 the extent of which is determined automatically and precisely based on variations in the statistical behaviour of each of such instruments 14,15.

The operation of the plant 10 for filling bottles or containers according to the present invention is the following.

Initially, there is data collection (step 110) wherein each datum is associated with a particular tap or filling valve 15 and with a particular closing and/or capping head 14.

The data collected is data coming from the control stations 13',13" and it comprises at least one datum relative to the fill level of the containers 16 treated and/or a datum relative to the capping characteristics (screwing height and/or reclosing angle and/or removal torque).

Once a significant statistical sample of measurements of the fill levels of the containers 16 all treated by the same tap or filling valve 15 has been collected, the statistical data of such a tap 15 is calculated (step 120), like for example the average value and the standard deviation of the fill level generated by it.

The statistical data is updated (step 130) upon every new measurement still keeping track of the progression thereof, in order to detect a variation in the operation of the single taps 15 such as to require a calibration (step 140) to bring the tap back to obtain the fill level initially set.

The data collected concerning the capping height obtained through a specific capping head 14 is also treated in an analogous manner, therefore determining (step 120) statistical data from it and monitoring (step 130) a possible gradual variation over time thereof. In the case in which a variation is found, the relative capping head 14 is calibrated automatically (step 140) so as to compensate for the deviation with respect to the capping height initially set.

In this way it is therefore possible to detect slow and gradual variations in the behaviour of capping heads 14 and filling caps 15 in general due to wear or creep, and compensate fonts effects automatically.

Preferably, for an even more precise evaluation of the behaviour of the filling taps 15 the weight of the filled container also detected so as no have a second reference value indicating the fill level. The data detecting concerning the weight of the filled container is also processed statistically and a possible variation thereof over time with consequent changing of the fill level initially set is monitored.

A suitable correlation of the results obtained concerning the fill level and the weight provides a more accurate analysis of possible variations of the statistical data over time.

In the case in which electronic capping heads 14 are used, in order to have a precise calibration thereof it is necessary to detect the reclosing angle and/or the removal torque, preferably in addition to the capping height 14.

Such data, detected for a specific capping head 14, is also subjected to statistical analysis and the statistical data obtained is monitored in order to detect a variation over time thereof, and in particular a variation of the reclosing angle and/or of the removal torque applied by the specific capping head 14. In this way, it is possible to automatically calibrate the electronic capping head 14 by bringing the angle and/or removal torque values to those set initially.

From the description that has been made the characteristics of the plant for filling bottles and containers and of the method for calibrating the plant for filling bottles and containers of the present invention are clear, just as the relative advantages are also clear.

Thanks to the tracking of the filling valves and of the capping heads, and to the electronic processing unit connected to the single control stations, the filling plant according to the present invention is able to associate the collected data to a particular capping valve and/or filling head and reprocess it so as to obtain a quantitative measurement of a growth in the difference between the set parameters and those actually obtained, in general due to wear or creep of the particular tool monitored.

In this way, the processing unit can determine suitable modifications in the operative settings of the tools monitored, compensating for a possible shift from the set parameters due to wear or creep. There is thus a continuous calibration through self-regulation of the filling valves and capping heads that keeps the fill level and the capping characteristics at set levels.

Moreover, in the case in which the plant also has a module for measuring the removal torque and/or the reclosing angle, the continuous calibration can also take place in relation to electronic capping heads.

Finally, it is clear that the plant thus conceived can undergo numerous modifications and variants, all of which are covered by the invention; moreover, all of the details can be replaced by technically equivalent elements.

For example, the filling plant according to the present invention can also be advantageously provided with control stations provided, in addition, with a module for measuring the tension of she side walls, the gas content and/or pressure, and the colour.

In practice, the materials used, as well as the sizes, can be whatever according to the technical requirements.

The invention claimed is:

1. Plant (10) for filling containers comprising conveying means on which a plurality of containers (16) are moved along a direction of forward movement on a main forwarding route of said containers (16), with there being, arranged in succession along said direction of forward movement, a first station (11) for filling said containers (16), said first station comprising a plurality of filling valves (15), a second station (12) for capping said containers (16), said second station comprising a plurality of capping heads (14) and at least one third control station (13', 13") for checking at least one filling parameter, characterised in that said plant (10) comprises a tracking system (18, 19, 20) for tracking filling valve (15) and capping head (14) that acts upon containers (16), and a processing unit (21) connected to said at least one third control station (13', 13") for receiving filling and closing parameters of said containers (16) on which said filling valve (15) and said capping head (14) act, said processing unit (21) also being connected to means for adjusting said first station and said second station (11, 12) suitable for controlling the operating parameters of said filling valve (15) and said capping head (14) that act upon said containers (16) based on said filling and closing parameters wherein at least one third control station (13") is arranged along a secondary branch (17) parallel to said main forwarding route of said containers (16).

2. Plant (10) for filling containers according to claim 1, characterised in that said conveying means comprise a plurality of discreet positions for said containers (16), said tracking system comprising a first sensor (18) suitable for detecting the passage of a first container (16), a second sensor (19) associated with a first filling valve (15), a third sensor (20)

associated with a first capping head (14) and an encoder associated with said discreet conveying means so as to keep track of the instantaneous positions of said first container (16), said first filling valve (15), and said first capping head (14).

3. Plant (10) for filling containers according to claim 1, characterised in that said at least one third control station (13', 13") comprises at least one module for measuring the filling level and at least one module for measuring the capping height and a module for measuring the removal torque and the reclosing angle of a cap.

4. Plant (10) for filling containers according to claim 3, characterised in that said at least one third control station (13', 13") also comprises at least one measuring module selected from the group consisting of:

a module for measuring container side wall tension, a module for measuring container gas content and/or pressure, a module for measuring container weight, and a module for measuring container colour.

5. Plant (10) for filling containers according to claim 1, characterised in that said at least one third control station (13") arranged along a secondary- branch (17) comprises at least one module from a module for measuring the removal torque and/or the reclosing angle of a container cap, a module for measuring gas content and/or pressure of a container, a module for measuring the weight of a container and a module for measuring the colour of a container.

6. Plant (10) for filling containers according to claim 1, characterised in that said processing unit (21) comprises software means (22) suitable for implementing the method (100) for calibrating a plant (10) for filling containers by collecting (110) at least one set of data relating to filling and closing parameters of containers (16) treated through the same filling valve (15) of said filling plant (10) and through the same capping head (14) of said filling plant (10);

based on said collected data, calculating (120) statistical data associated with said filling valve (15) and/or with said closing capping head (14);

updating (130) said statistical data based on new data collected and monitoring the progression thereof over time; in the case of a variation over time of said statistical data, adjusting (140) said filling valve (15) and capping head (14) associated with said statistical data so as to compensate for said variation.

* * * * *